US009065199B2

(12) United States Patent
Mizutani et al.

(10) Patent No.: US 9,065,199 B2
(45) Date of Patent: Jun. 23, 2015

(54) CONNECTOR WITH ENTRANCE RESTRICTING PORTIONS IN A RECEPTACLE TO PREVENT DAMAGE TO TABS IN THE RECEPTACLE

(71) Applicant: Sumitomo Wiring Systems, Ltd., Yokkaichi, Mie (JP)

(72) Inventors: Yoshihiro Mizutani, Yokkaichi (JP); Shinji Hirano, Yokkaichi (JP); Keishi Kitamura, Yokkaichi (JP); Takao Hata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 8 days.

(21) Appl. No.: 13/974,091

(22) Filed: Aug. 23, 2013

(65) Prior Publication Data

US 2014/0065861 A1 Mar. 6, 2014

(30) Foreign Application Priority Data

Sep. 6, 2012 (JP) ..... 2012-196313

(51) Int. Cl.

| | |
|---|---|
| ***H01R 24/00*** | (2011.01) |
| ***H01R 13/64*** | (2006.01) |
| ***H01R 13/641*** | (2006.01) |
| ***H01R 13/56*** | (2006.01) |
| ***H01R 13/629*** | (2006.01) |
| ***H01R 13/44*** | (2006.01) |
| ***H01R 13/645*** | (2006.01) |
| *H01R 13/52* | (2006.01) |

(52) U.S. Cl.

CPC ..... *H01R 13/56* (2013.01); *H01R 24/00* (2013.01); *H01R 13/629* (2013.01); *H01R 13/44* (2013.01); *H01R 13/6456* (2013.01); *H01R 13/5227* (2013.01)

(58) Field of Classification Search

CPC ..... H01R 13/64; H01R 13/56; H01R 13/44; H01R 13/639

USPC ..... 439/660, 680, 137, 140, 141, 157, 752, 439/598, 372, 374–378

See application file for complete search history.

(56) References Cited

U.S. PATENT DOCUMENTS

| | | | | |
|---|---|---|---|---|
| 4,580,868 | A | 4/1986 | Verstijnen | |
| 6,830,485 | B2 * | 12/2004 | Koehler et al. | 439/660 |
| 7,121,895 | B2 | 10/2006 | Shiga | |

(Continued)

FOREIGN PATENT DOCUMENTS

JP 2011-040327 2/2011

OTHER PUBLICATIONS

European Patent Appl. No. 13 003 930.8—Search Report issued on Nov. 20, 2014.

*Primary Examiner* — Abdullah Riyami
*Assistant Examiner* — Harshad Patel
(74) *Attorney, Agent, or Firm* — Gerald E. Hespos; Michael J. Porco; Matthew T. Hespos

(57) ABSTRACT

Entrance restricting portions (30, 31, 32) project in a receptacle (100) and are arranged in a width direction at each of opposite sides of a plurality of tabs (20, 21) in a height direction. Drop-in spaces (3A-3E) are formed at an inner side of the entrance restricting portions (30, 31) and (32) adjacently arranged at the substantially opposite sides of the tabs (20, 21). When a spherical surface of a spherical body (201) inserted into the receptacle (10) contacts the front ends of a plurality of entrance restricting portions (30, 31, 32), a top (202) on a central axis of the spherical body (201) is offset from the tabs (20, 21).

11 Claims, 23 Drawing Sheets

(56) References Cited

U.S. PATENT DOCUMENTS

| | | | | |
|---|---|---|---|---|
| 8,827,731 | B2 | 9/2014 | Sasaki et al. | |
| 2005/0239337 | A1* | 10/2005 | Shiga | 439/660 |
| 2009/0111130 | A1 | 4/2009 | Hiramatsu | |
| 2009/0149057 | A1* | 6/2009 | Takeda | 439/374 |
| 2012/0315784 | A1 | 12/2012 | Pankau | |
| 2013/0078846 | A1 | 3/2013 | Sasaki et al. | |

* cited by examiner

CONNECTOR WITH ENTRANCE RESTRICTING PORTIONS IN A RECEPTACLE TO PREVENT DAMAGE TO TABS IN THE RECEPTACLE

BACKGROUND

1. Field of the Invention

The invention relates to a connector.

2. Description of the Related Art

Japanese Unexamined Patent Publication No. 2011-40327 discloses a connector with a tubular receptacle into which a mating connector can be fit. The receptacle has a back wall and a peripheral wall projects forward from a peripheral part of the back wall. Tabs are mounted through the back wall and project forward in the receptacle. The tabs are parallel to one another and are arranged in a width direction.

Ribs are formed in the receptacle and grooves are formed on a housing of a mating connector for receiving the respective ribs. The two housings are connected smoothly by fitting the respective ribs into the corresponding grooves. On the other hand, the leading ends of the ribs interfere with wall surfaces of the mating connector to prevent connection if the two housings are in improper connecting postures.

The aforementioned ribs are designed to prevent erroneous connection of the connectors. Thus, the number of the ribs is small, there is no particular regularity in the array of the ribs and no particular attention is paid to a positional relationship of the ribs and the tabs. External matter could accidentally enter the receptacle from the front and may slip between the ribs to interfere with and deform the tabs. A body with a semispherical tip, such as a finger, could be inserted toward the back of the receptacle and leading ends of the ribs easily interfere with the top part of the spherical body.

The invention was completed in view of the above situation and aims to prevent deformation of tabs.

SUMMARY OF THE INVENTION

The invention relates to a connector with a receptacle that has a back wall and a peripheral wall that projects forward from the front surface of the back wall. Tabs are mounted through the back wall and arranged project forward in the receptacle. The tabs are substantially parallel to one another and are arranged in a width direction. Entrance restricting portions are formed in the receptacle and have front ends located before front ends of the tabs. At least three of the entrance restricting portions are arranged in the width direction at each of the opposite sides of the tabs in a height direction. Drop-in spaces are arranged successively in the width direction in the receptacle. Each drop-in space is formed at an inner side of a plurality of the entrance restricting portions adjacently arranged at opposite sides of the tabs. When a semi-spherical or spherical body is inserted into the receptacle from the front and introduced such that a semi-spherical or spherical surface of the body contacts the front ends of the entrance restricting portions and a top on a central axis of the semi-spherical or spherical body is inserted into the drop-in spaces, the tabs are arranged at positions different from the top in a planar view in any of the plurality of drop-in spaces. Thus, the external matter, such as the semi-spherical or spherical body, will not interfere with or deform the tabs.

An array area preferably is defined where the entrance restricting portions are arranged on opposite sides in the height direction and at substantially equal intervals in the width direction. There also is an array area where the tabs are located between the entrance restricting portions, are arranged on opposite sides in the height direction and are arranged at substantially equal intervals in the width direction. Thus, the respective drop-in spaces have substantially the same opening width in the array areas, and there is no likelihood that some of the drop-in spaces have a wide opening width. Thus, the top of the spherical body cannot be inserted deeply into a widely open drop-in space and cannot interfere with the tabs.

An overlap area preferably exists where the entrance restricting portions arranged on the opposite sides in the height direction and the tabs located between the entrance restricting portions arranged on the opposite sides in the height direction are arranged to overlap with respect to the width direction. Thus, the top of the spherical body that is inserted into the drop-in space.

The overlap area preferably includes an identical phase area where widthwise centers of the entrance restricting portions are at the same positions as widthwise centers of the respective tabs in the width direction. A positional relationship between the tabs and the entrance restricting portions is clear in the identical phase area and the regularity of the arrays of the tabs and the entrance restricting portions is ensured.

Each entrance restricting portion is at least as wide as the respective tab in the overlap area. Thus, the entrance restricting portions make the tabs less susceptible to interference and less likely to be deformed.

The front end of each entrance restricting portions preferably defines a reverse taper that overhangs forward toward the drop-in spaces. Thus, external matter inserted into the receptacle is guided to the outside of the drop-in space and away from the tabs.

The entrance restricting portions arranged on the opposite sides in the height direction preferably are coupled integrally or unitarily to the inner surface of the peripheral wall.

The outer surface of the peripheral wall preferably is recessed to form thinned portions at positions facing and substantially opposite to the respective entrance restricting portions. The thinned portions prevent the formation of sinks on the peripheral wall of the receptacle during molding. Further, this can ensure a large width for the base ends of the entrance restricting portions coupled to the peripheral wall of the receptacle.

At least one water drainage portion is formed on the outer surface of the peripheral wall. The water drainage portion extends in a direction intersecting forward and backward directions, communicates with the thinned portions and is open on both ends in an extending direction. Water easily could pool in the thinned portions formed in the outer surface of the peripheral wall. However, the water can drain to outside via the water drainage portion and will not pool in the thinned portions.

At least one of the entrance restricting portions includes a narrow base coupled to the inner surface of the peripheral wall and a leading end that is wider than the base and that is located in the drop-in space. The narrow base of the entrance restricting portion prevents the formation of sinks on the peripheral wall of the receptacle during molding. On the other hand, the wide leading end of the entrance restricting portion interferes more reliably and prevents interference of external matter with the tabs.

The entrance restricting portions preferably are separated from the peripheral wall for reliably preventing the formation of sinks on the peripheral wall and the deflection of the peripheral wall during molding.

These and other features and advantages of the invention will become more apparent upon reading the following detailed description of preferred embodiments and accompanying drawings. Even though embodiments are described separately, single features thereof may be combined to additional embodiments.

DETAILED DESCRIPTION OF THE PREFERRED EMBODIMENTS

A first embodiment of the invention is described with reference to FIGS. 1 to 11. In the following description, connecting surfaces of a connector and a mating connector are referred to as front ends concerning forward and backward directions.

Figure 1:
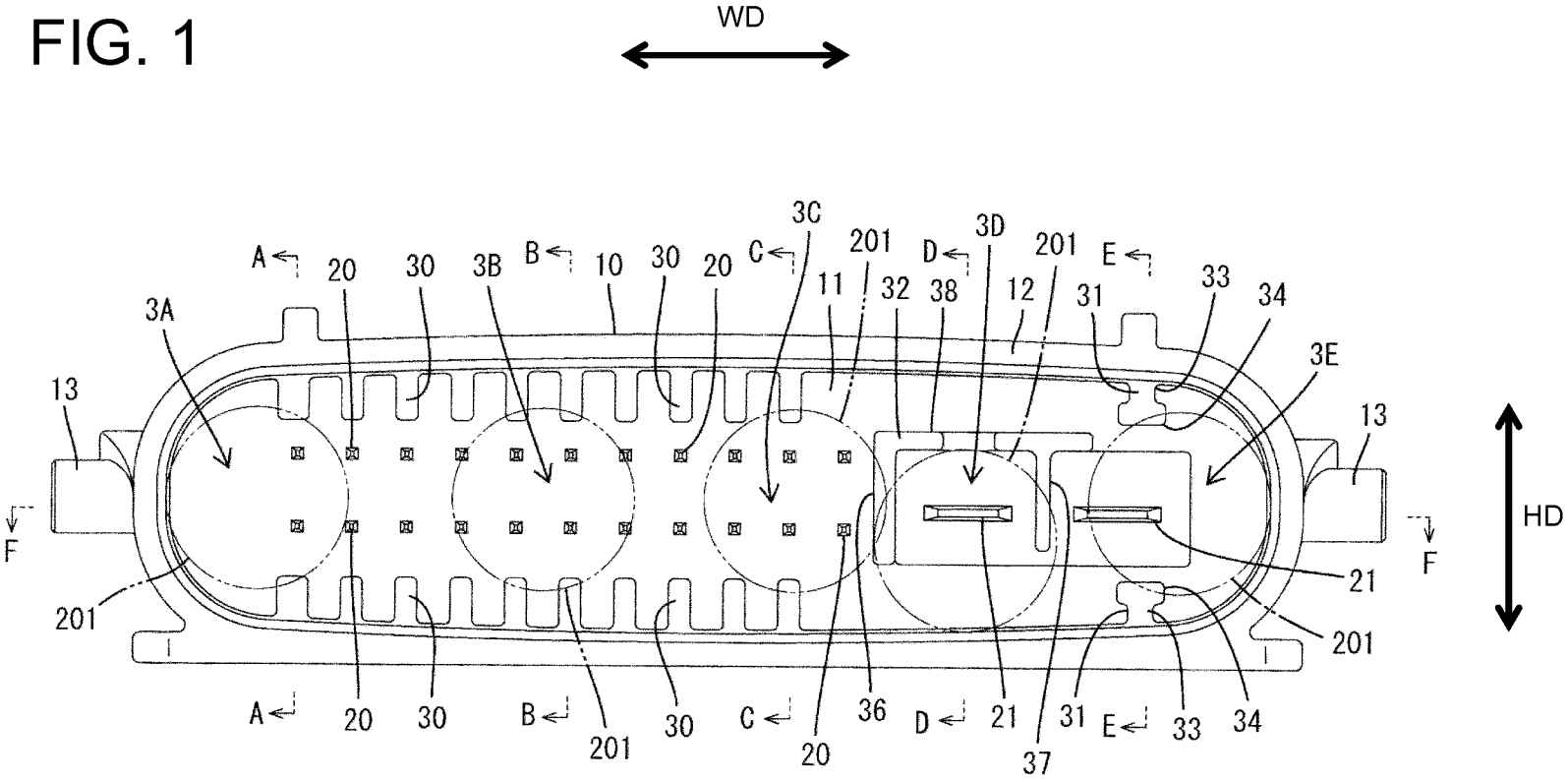
FIG. 1 is a front view of a connector of a first embodiment of the invention.
Figure 7:
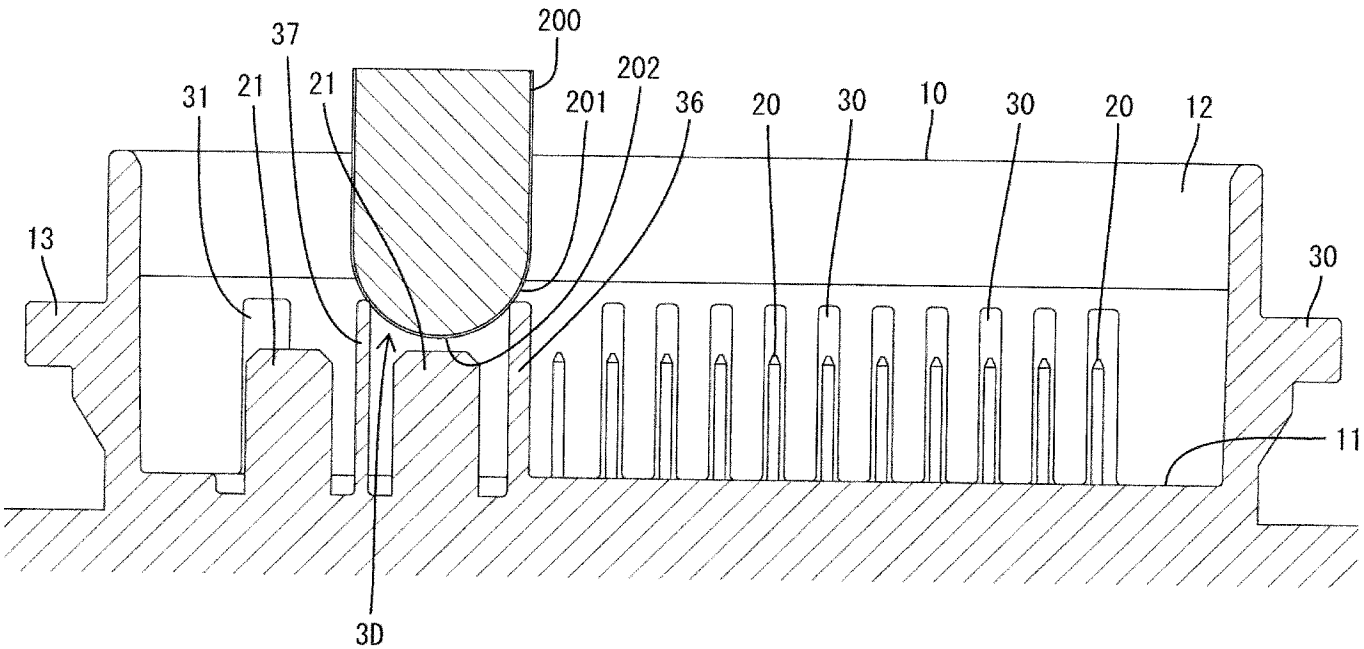
FIG. 7 is a section along F-F of FIG. 1 showing the state of FIG. 2.
Figure 8:
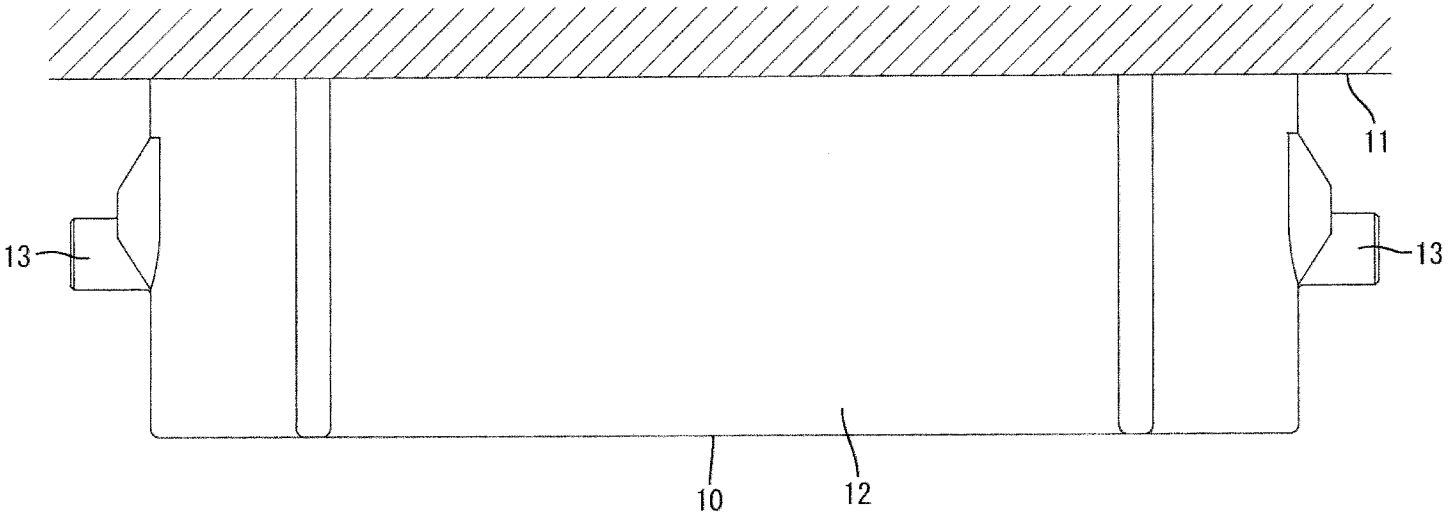
FIG. 8 is a plan view of a connector.
Figure 9:
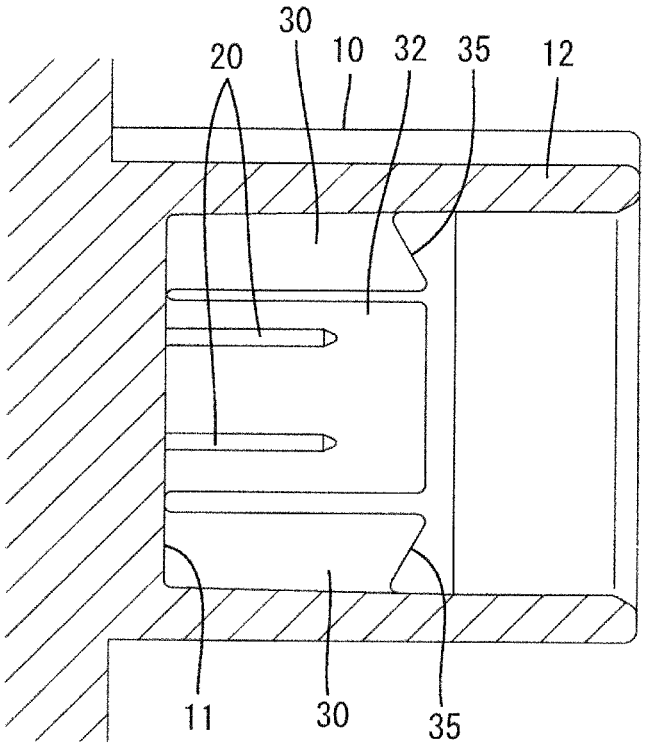
FIG. 9 is a section of the connector.
Figure 11:
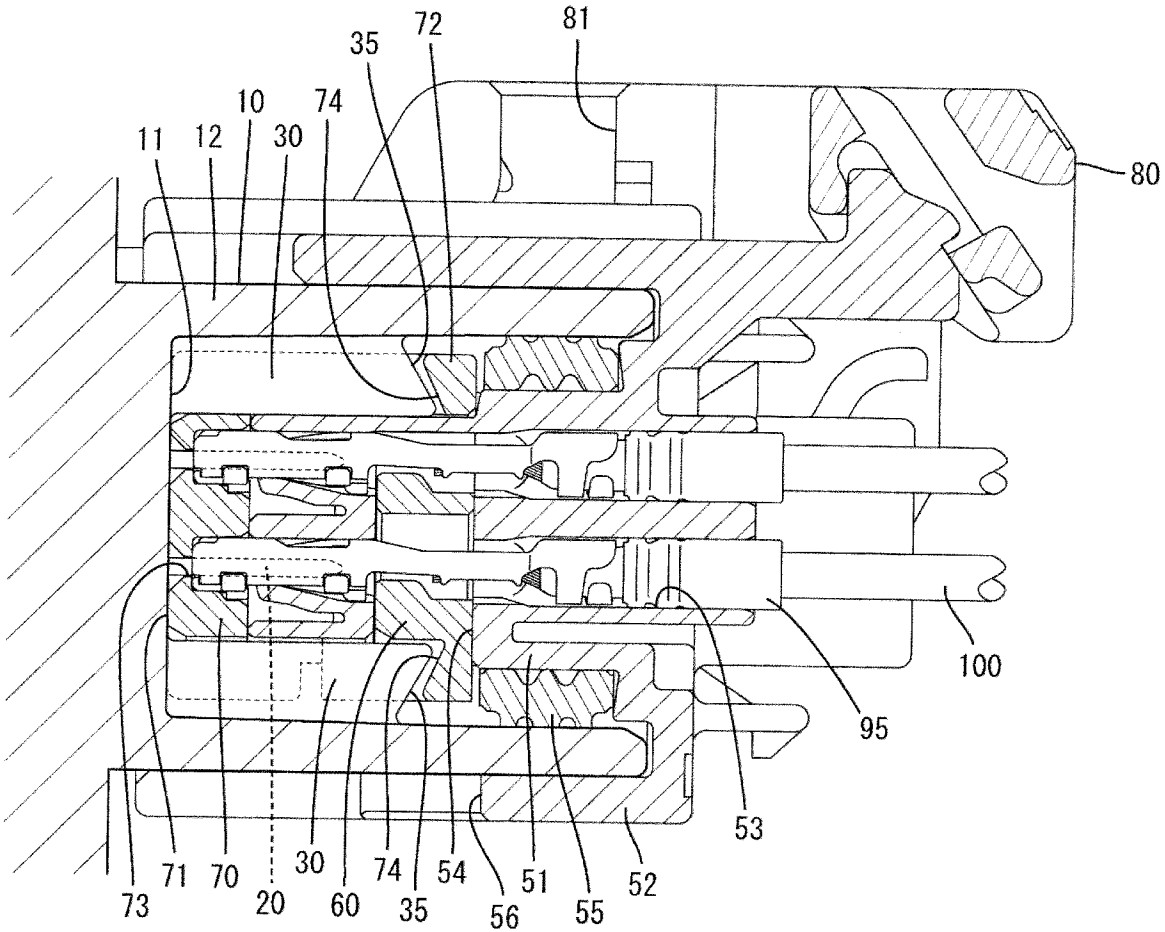
FIG. 11 is a section of two connectors in a properly connected state.

The connector has a receptacle 10 made e.g. of synthetic resin. As shown in FIGS. 1, 7 and 9, the receptacle 10 includes a back wall 11 arranged along a height direction HD and a width direction WD and a peripheral wall 12 projecting forward from the front surface of the back wall 11. The receptacle 10 is long in the width direction WD and short in the height direction HD. As shown in FIG. 11, the mating connector can fit into the receptacle 10 from the front. As shown in FIG. 8, cam followers 13 project on opposite widthwise end parts of the outer surface of the peripheral wall 12. The cam followers 13 are cylindrical and can engage with cam grooves 81 formed on a lever 80 of the mating connector.

As shown in FIGS. 1 and 9, tabs 20, 21 are mounted through the back wall 11. The tabs 20, 21 are made e.g. of electrically conductive metal and project forward from the front surface of the back wall 11. As shown in FIG. 1, the tabs 20 define substantially rectangular pins that are long and narrow in forward and backward directions and are arranged in parallel upper and lower rows that extend in the width direction WD. The two tabs 21 are flat plates that are arranged side-by-side in a single plane along the width direction WD and at a central part of the receptacle 10 in the height direction HD. The respective pin-like tabs 20 are arranged vertically symmetrically with respect to a height direction HD and are at substantially equal intervals in the height direction HD and the width direction WD. An area where the pin-like tabs 20 are arranged is called an "array area" in the following description.

As shown in FIG. 1, first, second and third entrance restricting portions 30, 31, 32 are formed in the receptacle 10 and project forward from the front surface of the back wall 11 substantially parallel to the respective tabs 20, 21. Additionally, the first and second entrance restricting portions 30, 31 project unitarily in from the inner surface of the peripheral wall 12. Inner ends of the first and second entrance restricting portions 30, 31 are substantially parallel in the width direction WD and are arranged in pairs at opposite sides of the respective tabs 20, 21 in the height direction HD. The front ends of all of the entrance restricting portions 30, 31 and 32 are located before front ends of the tabs 20, 21 and are at substantially the same position as one another in forward and backward directions.

The second entrance restricting portions 31 are located at the right side and each has a substantially T-shaped cross-section with a narrow base 33 coupled to the inner surface of the peripheral wall 12 and a wide leading end 34 located in the receptacle 10. The two second entrance restricting portions 31 align with the plate-like tab 21 on the right side and are at opposites of the plate-like tab 21 in the height direction HD.

The first entrance restricting portions 30 are long and narrow rectangular ribs that extend in forward and backward directions and have substantially the same width over the entire length in the height direction HD. The first entrance restricting portions 30 are arranged at substantially equal intervals at positions corresponding to the respective pin-like tabs 20. Specifically, the respective first entrance restricting portions 30, except those on the left end particularly are shaped and sized identically and are arranged at positions vertically overlapping with the corresponding pin-like tabs 20. More specifically, all of the entrance restricting portions 30, 31 and 32 are wider than the pin-like tabs 20 and the first entrance restricting portions 20, except those on the left side, have widthwise centers at the same positions as those of the respective pin-like tabs 20 in the width direction WD.

No first entrance restricting portions 30 are formed at positions corresponding to the pin-like tabs 20 on the right side. In the following description, an area where the respective first entrance restricting portions 30 are arranged is called an array area, an area where the respective first entrance restricting portion 30 and the respective pin-like tabs 20 overlap with respect to the width direction WD is called an "overlap area" and an area where the widthwise centers of the first entrance restricting portions 30 (except those on the shown left end) and the widthwise centers of the respective pin-like tabs 20 are aligned at the same positions in the width direction WD is called an identical phase area.

Figure 2:
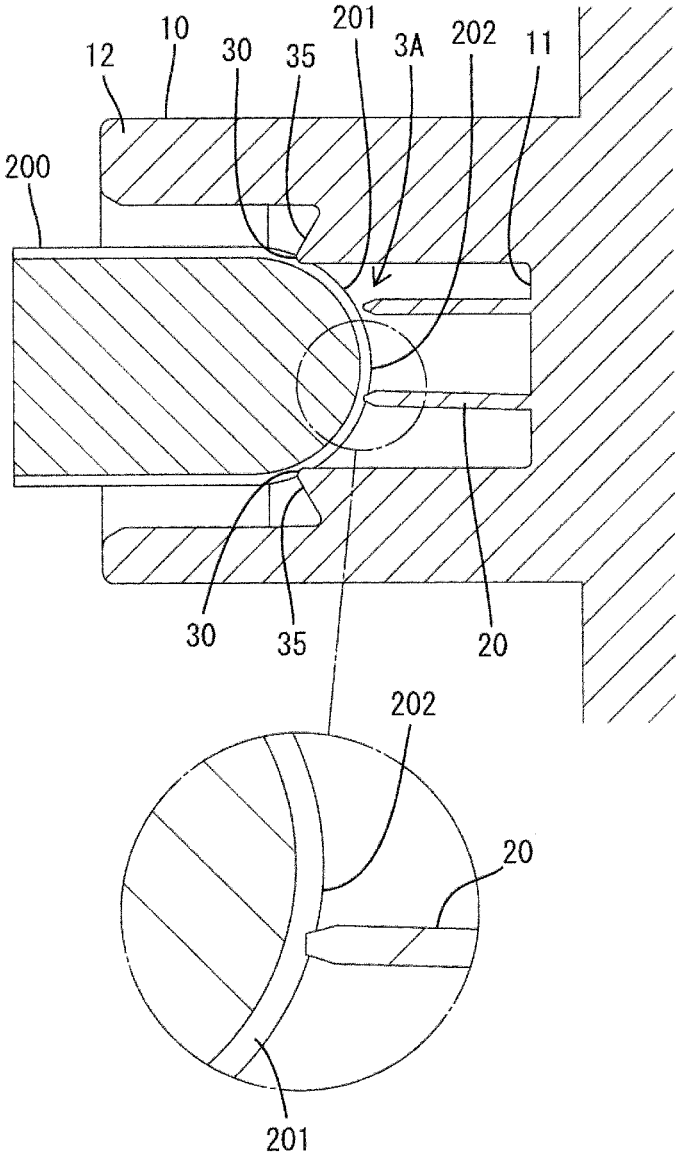
FIG. 2 is a section along A-A of FIG. 1 in a state where a spherical body is inserted into a receptacle.
Figure 6:
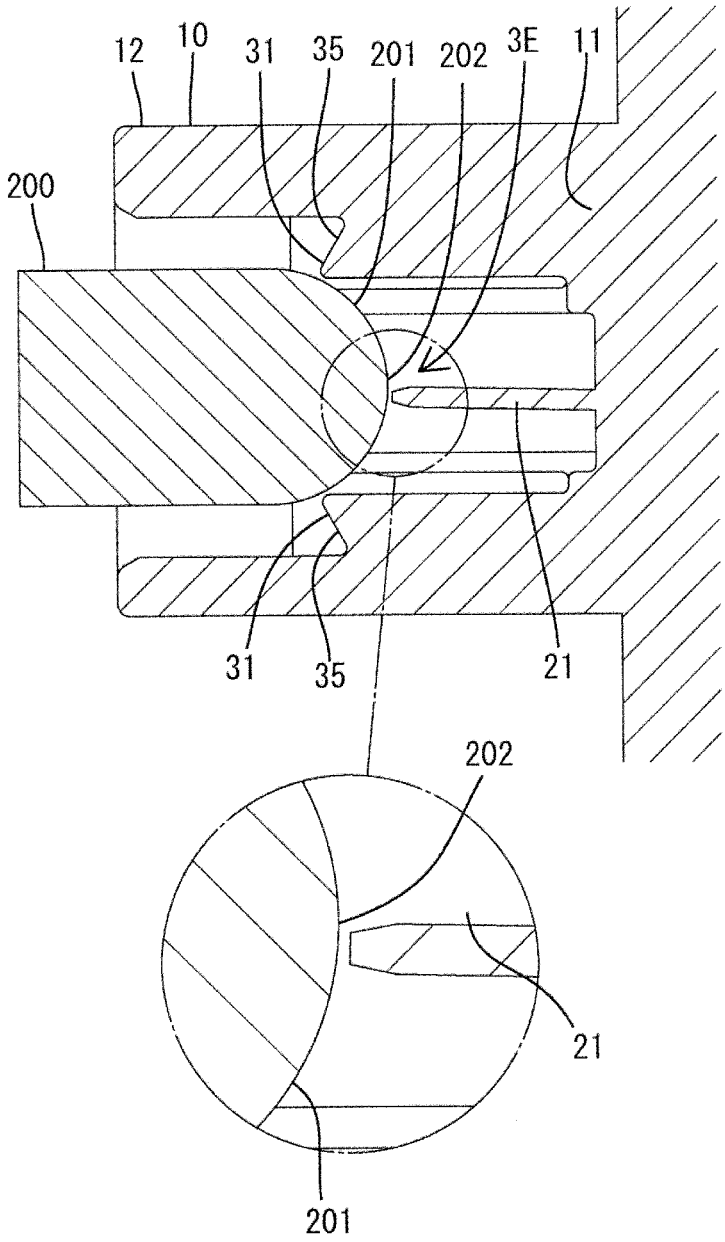
FIG. 6 is a section along E-E of FIG. 1 showing the state of FIG. 2.

As shown in FIGS. 2 and 6, the front ends of the first and second entrance restricting portions 30, 31 have reverse tapers 35 that are overhanging or undercut forward toward a central side of the receptacle 10 in the height direction HD. The inner ends of the first and second entrance restricting portions 30, 31 are pointed due to the reverse tapers 35. In this embodiment, the reverse tapers 35 are set substantially at the same angle of inclination on the first and second entrance restricting portions 30, 31.

As shown in FIG. 1, the third entrance restricting portion 32 is spaced from the peripheral wall 12 and partly surrounds the two left plate-like tabs 21. Specifically, the third entrance restricting portion 32 includes a thick vertical wall 36 between the plate-like tab 21 and the pin-like tabs 20, a thin vertical wall 37 between the plate-like tabs 21, and a horizontal wall 38 coupling upper ends of the thick and thin vertical walls 36, 37.

Figure 10:
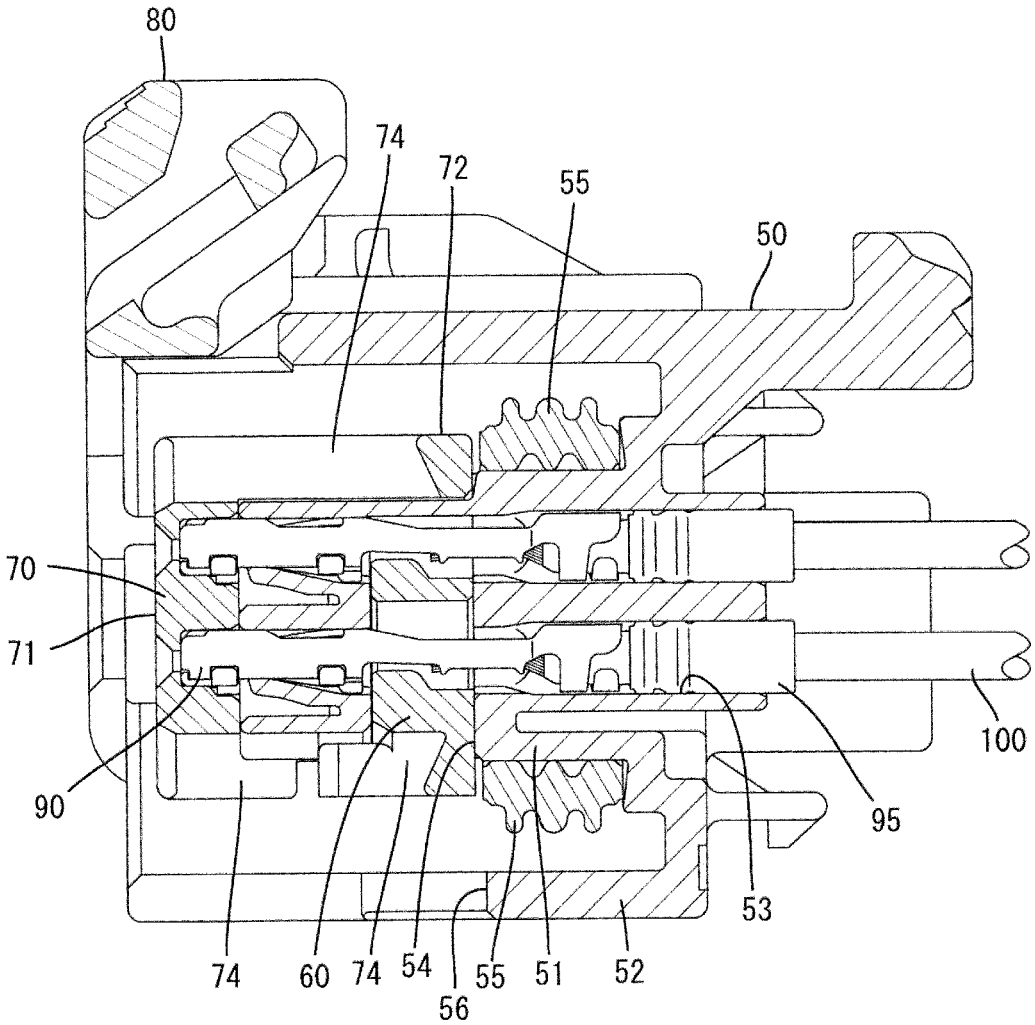
FIG. 10 is a section of a mating connector.

As shown in FIG. 10, the mating connector includes a housing 50, a retainer 60, a front mask 70 and the lever 80.

The housing 50 includes a block-shaped main body 51 and a fitting tube 52 at least partly surrounding the housing main body 51. As shown in FIG. 11, the peripheral wall 12 of the receptacle 10 is to be inserted into a space between the housing main body 51 and the fitting tube 52 from the front. A seal ring 55 is mounted on the outer surface of the housing main body 51. At the time of a connecting operation, the seal ring 55 is compressed resiliently between the peripheral wall 12 and the housing main body 51 to provide sealing between the two connectors.

As shown in FIG. 10, the housing main body 51 is formed with cavities 53 at positions corresponding to the respective tabs 20, 21. A female terminal fitting 90 is to be inserted into each cavity 53 from behind. A resilient or rubber plug 95 is mounted compressively on the female terminal fitting 90 and is to be inserted into each cavity 53 while being held in close contact. Further, each female terminal fitting 90 is connected to an end portion of a wire 100 that is pulled out from the rear of the housing main body 51.

As shown in FIG. 10, a retainer mounting portion 54 is formed in the lower surface of the housing main body 51 and communicates with all of the cavities 53. The retainer 60 is inserted into the retainer mounting portion 54 and locks the female terminal fittings 90. An escaping recess 56 is formed on the lower wall of the fitting tube 52 and receives the retainer 60. Further, the lever 80 is supported pivotably on opposite side walls of the fitting tube 52. The lever 80 is formed with two cam grooves 81 and the cam followers 13 enter the cam grooves 81 when the connectors are fit lightly together. The cam followers 13 slide along the cam grooves 81 as the lever 80 is pivoted to display a cam action that connects the two connectors with a small operation force.

The front mask 70 includes a front plate 71 for covering the front surface of the housing main body 51 and a peripheral plate 72 projecting back from the periphery of the front plate 71. As shown in FIG. 11, the front plate 71 is formed with tab insertion holes 73 at positions corresponding to the cavities 53, and the respective pin-like tabs 20 are insertable into the tab insertion holes 73. The front mask 70 also is formed with entrance restricting receiving grooves 74 for receiving the respective entrance restricting portions 30, 31 and 32 during the connecting operation. The entrance restricting receiving grooves 74 that receive the first and second entrance restricting portions 30, 31 extend in forward and backward directions from the front plate 71 to the peripheral plate 72, as shown in FIG. 10. The entrance restricting receiving grooves 74 are arranged parallel in the width direction WD at positions corresponding to the respective first and second entrance restricting portions 30, 31. Note that the lower surface of the peripheral plate 72 is formed with an opening for receiving the lower wall of the retainer 60, and the entrance restricting receiving grooves 74 also are formed in the lower wall of the retainer 60 to continue from the peripheral wall 12 side.

The presence of the entrance restricting receiving grooves 74 in the peripheral wall 12 requires the front mask 70 to be extended radially to ensure the plate thickness of the peripheral wall 12 and requires a corresponding increase in the dimensions of an opening of the receptacle 10 into which the front mask 70 is to be fit. As a result, an external matter, such as a finger, can easily enter the receptacle 10 from the front, and the respective tabs 20, 21 may be deformed by the external matter.

In view of the above, the array of the entrance restricting portions 30, 31 and 32 is determined in consideration of a positional relationship with the respective tabs 20, 21 so that external matter cannot contact the respective tabs 20, 21. Specifically, as shown in FIG. 2, a cylindrical member 200 is prepared as a model of an external matter, and the positions of the respective entrance restricting portions 30, 31 and 32 are specified so that a tip of the cylindrical member 200 does not contact the tabs 20, 21. The tip of the cylindrical member 200 is a spherical body 201 having a semispherical surface and, for example, resembles a fingertip or a jig. A plane cross-sectional shape of the spherical body 201 at an intermediate position in the height direction is semicircular and a top 202 is located on a center axis of the spherical surface of the spherical body 201. When the spherical body 201 is inserted into the receptacle 10, the top 202 is inserted most deeply to the back side of the receptacle 201.

As shown in FIG. 1, drop-in spaces 3A to 3E are defined between the entrance restricting portions 30, 31 and 32 adjacently arranged at opposite sides of the tabs 20, 21 into which the spherical body 201 is to be introduced when the cylindrical member 200 is inserted into the receptacle 10 from the front. The drop-in spaces 3A to 3E are arranged successively in the width direction WD in the receptacle 10. Thus, the spherical body 201 is introduced successively into the respective drop-in spaces 3A to 3E from one to the other widthwise sides in the receptacle 10 as shown in FIG. 1 and can move in the width direction WD while moving forward and backward.

As shown in FIG. 1, the drop-in space 3A is formed adjacent the left inner surface of the peripheral wall 12 and between wide left-most pair of first entrance restricting portions 30, which are at opposite sides in the height direction HD of the pin-like tabs 20 on the left end. As shown in FIGS. 1 and 2, the spherical body 201 introduced into the drop-in space 3A has the spherical surface thereof supported on the front ends of the reverse tapered portions 35 of the first entrance restricting portions 30.

Figure 3:
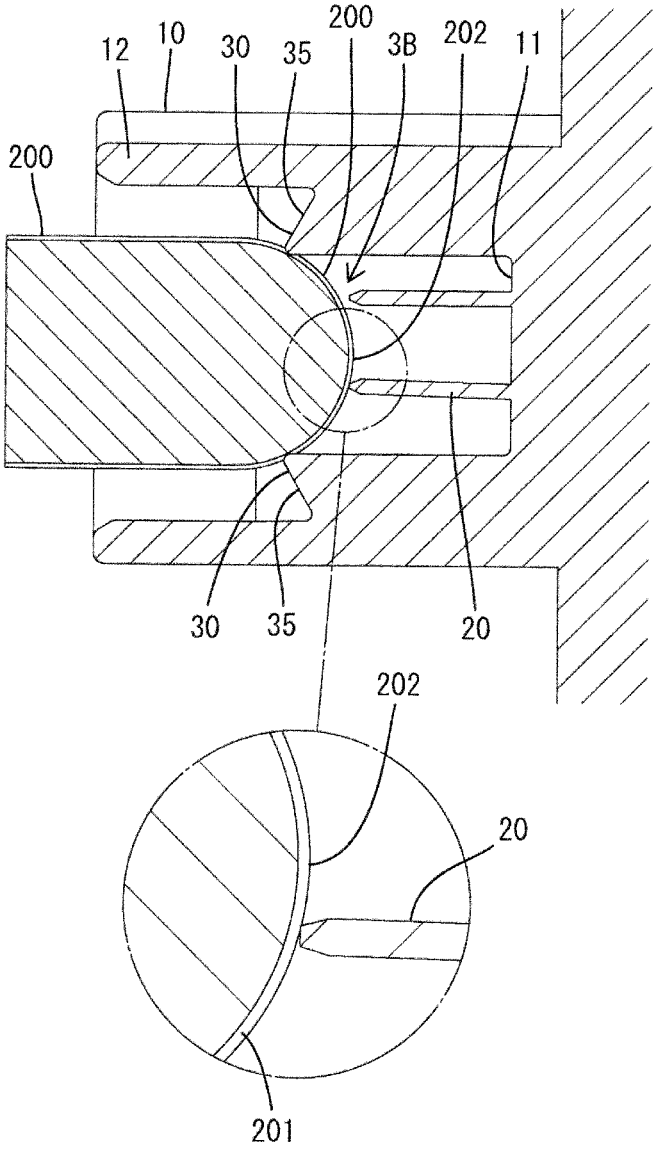
FIG. 3 is a section along B-B of FIG. 1 showing the state of FIG. 2.

Further, plural drop-in spaces 3B are formed between four first entrance restricting portions 30 that are at opposite sides of the pin-like tabs 20 that are adjacent in the height direction HD. As shown in FIGS. 1 and 3, the spherical body 201 that is introduced into one of the drop-in spaces 3B has the spherical surface thereof supported on the front ends of four of the first entrance restricting portions 30.

Figure 4:
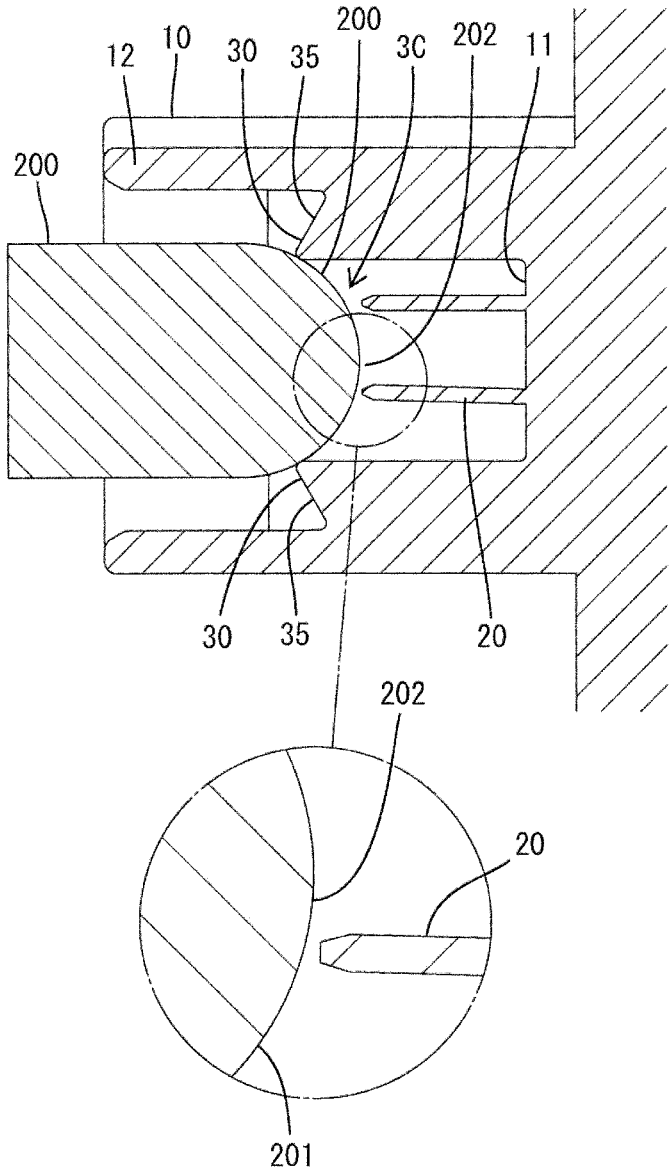
FIG. 4 is a section along C-C of FIG. 1 showing the state of FIG. 2.

The drop-in space 3C is formed between the thick vertical wall 36 of the third entrance restricting portion 32 and the two first entrance restricting portions 30 on the right end, which are at substantially opposite sides in the height direction HD of the pin-like tabs 20 on the right end. As shown in FIGS. 1 and 4, the spherical body 201 is introduced into the drop-in space 3C with the spherical surface thereof supported on the front ends of the first entrance restricting portions 30 and the front end of the thick vertical wall 36.

Figure 5:
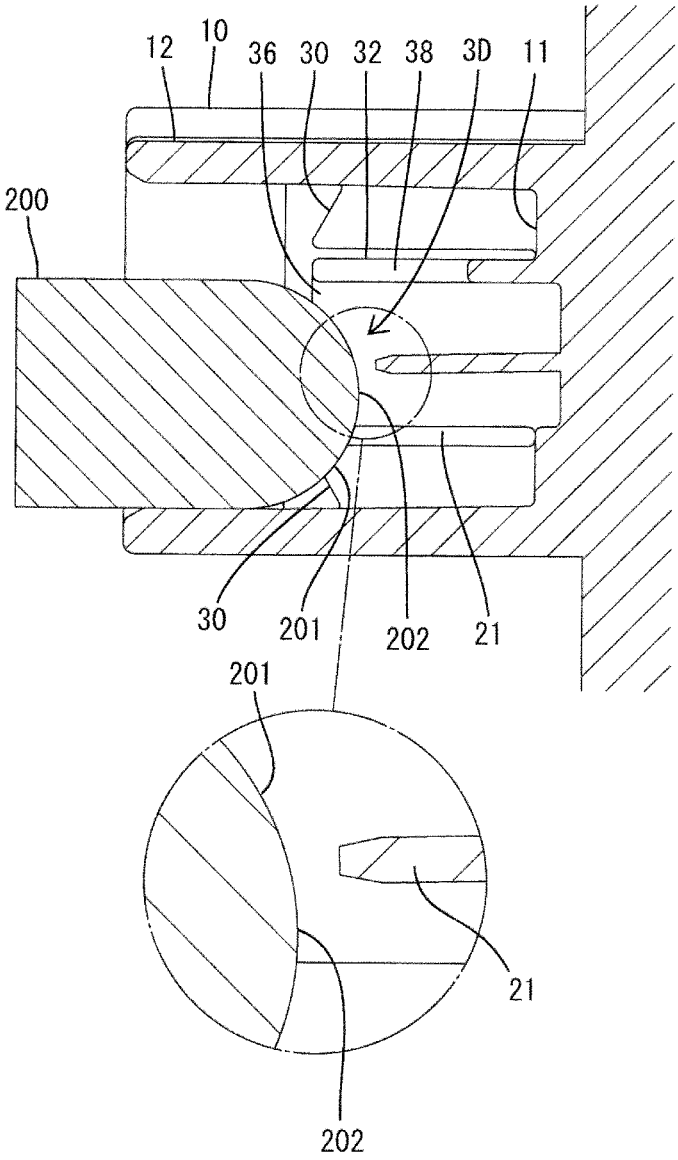
FIG. 5 is a section along D-D of FIG. 1 showing the state of FIG. 2.

The drop-in space 3D is formed between the thick and thin vertical walls 36, 37 located at the opposite sides of the left plate-like tab 21 in the width direction WD and the inner surface of the peripheral wall 12 on the right side of the receptacle 10. In this case, as shown in FIGS. 1, 5 and 7, the spherical body 201 is introduced into the drop-in space 3D with the spherical surface thereof supported on the front ends of the thick and thin vertical walls 36, 37 and held in contact with the lower end of the inner surface of the peripheral wall 12.

Furthermore, the drop-in space 3E is formed between the pair of second entrance restricting portions 31 located at the substantially opposite sides of the right plate-like tab 21 in the height direction HD and the right end of the inner surface of the peripheral wall 12 on the shown right side of the receptacle 10. In this case, as shown in FIGS. 1 and 6, the spherical body 201 is dropped or introduced into the drop-in space 3E with the spherical surface thereof supported on the front ends of the above pair of second entrance restricting portions 31 and held in contact with the right end of the inner surface of the peripheral wall 12.

As described above, the top 202 of the spherical body 201 is inserted most deeply into the drop-in spaces 3A to 3E the top 202, but does contact with the tips of the tabs 20, 21. That is, as shown in FIG. 1, the top 202 of the spherical body 201 and the front ends of the respective tabs 20, 21 are arranged at different positions in a planar view when the spherical body 201 is introduced into the respective drop-in spaces 3A to 3E.

Further, the tabs 20, 21 do not come into contact with any part of the spherical surface of the spherical body 201 including the top 202 when the spherical body 201 is introduced into the drop-in spaces 3A to 3E. In this case, as shown in FIG. 2, the pin-like tab 20 may be more forward than the top 202 of the spherical body 201, i.e. the spherical body 201 and the pin-like tab 20 may overlap in the height direction HD in the drop-in space 3A.

As described above, if the semi-spherical body 201 is inserted into the receptacle 10 from front, the surface of the semi-spherical body 201 contacts a plurality of adjacent entrance restricting portions 30, 31 and 32 and the top 202 on the center axis of the spherical body 201 is introduced into the drop-in space 3A to 3E. At this time, the tabs 20, 21 are at positions different from the top 202 in a planar view in any one of the plurality of drop-in spaces 3A to 3E. Thus, the tabs 20, 21 do not interfere with the top 202 and the deformation of the tabs 20, 21 by external matter, such as the spherical body 201, can be prevented.

The drop-in spaces 3B in each array area have substantially the same opening width in each array area where the first entrance restricting portions 30 are arranged and in each array area where the pin-like tabs 20 are arranged. As a result, the spherical body 201 cannot be introduced into a wider drop-in space 3B and the interference of the respective pin-like tabs 20 with the spherical body 201 can be avoided.

The overlap area exist where the first entrance restricting portions 30 and the pin-like tabs 20 overlap with respect to the width direction WD, and the tabs 20, 21 are at distances from the top 202 of the spherical body 201 that is introduced into the drop-in space 3B. As a result, interference of the pin-like tabs 20 with the spherical body 201 is avoided more reliably. In addition, the overlap area includes the identical phase area where the widthwise centers of the respective first entrance restricting portions 30 and those of the respective pin-like tabs 20 are at the substantially same positions in the width direction WD. This positional relationship between the pin-like tabs 20 and the first entrance restricting portions 30 becomes clear and the regularity of the arrays is ensured.

The first entrance restricting portions 30 are wider than the pin-like tabs 20 in the overlap area. Thus, the pin-like tabs 20 are protected by the first entrance restricting portions 30 and are not likely to be deformed external matter.

The front ends of the first and second entrance restricting portions 30, 31 have the reverse tapered portions 35 overhanging forward or undercut toward the drop-in spaces 3A to 3E. Thus, external matter, such as the spherical body 201, inserted into the receptacle 10 is guided to the outside of the drop-in space 3A to 3E so that interference with the tabs 20, 21 is avoided more reliably. Further, the inner ends of the reverse tapered portions 35 are substantially pointed. Thus, an operator feels a pain due to the interference of the fingertip with the inner end of the reverse tapered portion 35 and further insertion of the finger will not be attempted.

Each second entrance restricting portion 31 includes the narrow base 33 coupled to the inner surface of the peripheral wall 12 and the wide leading end 34 that is located in the drop-in space 3E. The narrow bases 33 prevent the formation of sinks on the peripheral wall 12 of the receptacle 10 during molding. On the other hand, the wide leading ends 34, will interfere with external matter to prevent interference of the plate-like tab 21 with the external matter.

Figure 12:
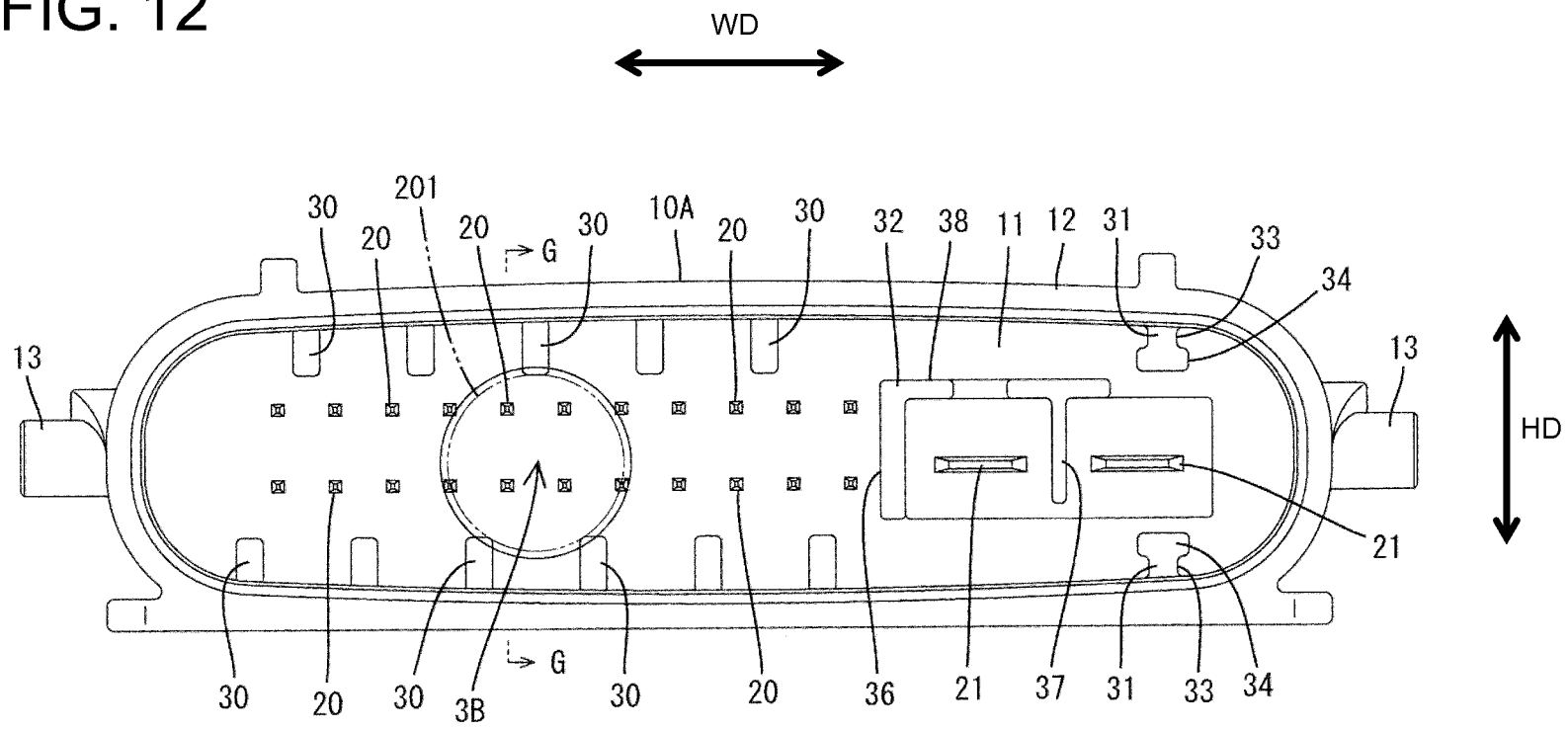
FIG. 12 is a front view of a connector of a second embodiment.
Figure 13:
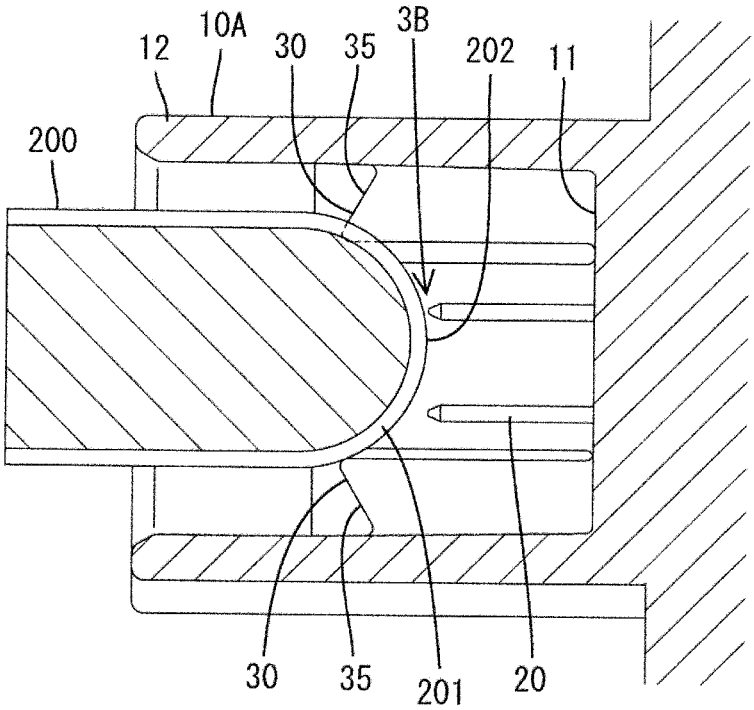
FIG. 13 is a section along G-G of FIG. 12 in a state where a spherical body is inserted into a receptacle.

FIGS. 12 and 13 show a second embodiment of the invention. Although the number and array of first entrance restricting portions 30 in the second embodiment are different from those of the first embodiment, the other structure is similar or the same as in the first embodiment. Thus, components are denoted by the same reference signs as in the first embodiment in FIGS. 12 and 13 except a receptacle denoted by 10A.

First entrance restricting portions 30 are arranged in the width direction on each of substantially opposite sides of the inner surface of a peripheral wall 12 in the height direction HD as in the first embodiment, and are arranged at substantially constant intervals in the width direction WD. The interval between the respective first entrance restricting portions 30 is larger than in the first embodiment, and the number of the respective first entrance restricting portions 30 is lower than in the first embodiment.

The first entrance restricting portions 30 are arranged at positions substantially facing intermediate or middle positions between pin-like tabs 20 adjacent in the width direction WD and the first entrance restricting portions 30 on one side in the height direction HD are offset in the width direction WD from those on the other side by half of the interval.

In this case, as shown in FIG. 13, a drop-in space 3B is formed at an inner side surrounded by three first entrance restricting portions 30 adjacent to each other at the substantially opposite sides of the pin-like tabs 20 in the height direction. Thus, the spherical body 201 is introduced into the drop-in space 3B with the spherical surface thereof supported on the front ends of the respective three adjacent first entrance restricting portions 30. Then, as shown in FIG. 13, the top 202 of the spherical body 201 is deeply inserted into the drop-in space 3B, but the spherical surface of the spherical body 201 including the top 202 does not come into contact with the respective pin-like tabs 20. Note that the pin-like tabs 20 are arranged at positions different from the top 202 in a planar view as in the first embodiment.

According to the second embodiment, the number of the respective first entrance restricting portions 30 can be reduced while the advantages of the first embodiment are enjoyed.

Figure 14:
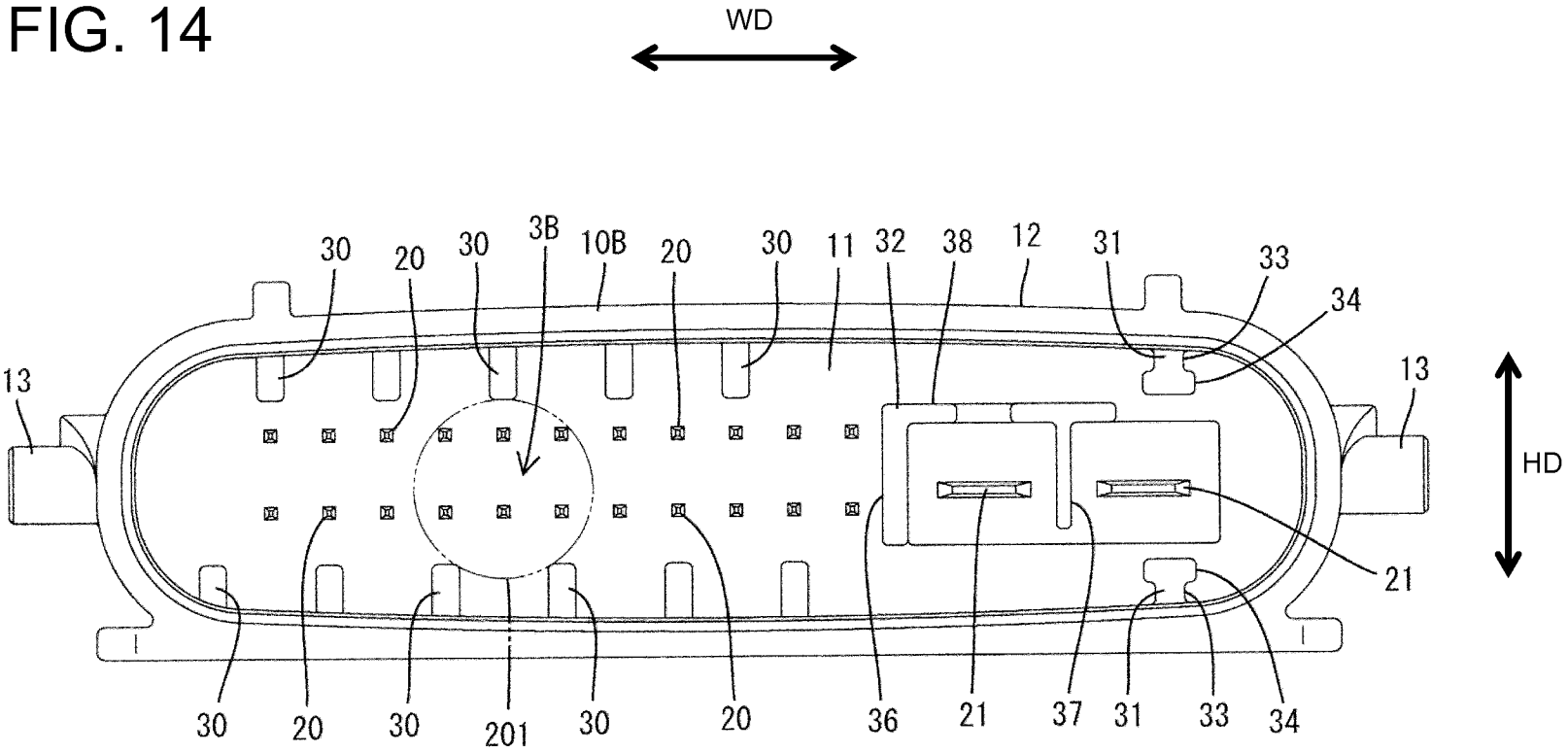
FIG. 14 is a front view of a connector of a third embodiment.

FIG. 14 shows a third embodiment of the invention. Although the number and array of first entrance restricting portions 30 in the third embodiment are different from those of the first embodiment, the other structure is similar or the same as in the first embodiment. Thus, components are denoted by the same reference signs as in the first embodiment in FIG. 14 except a receptacle denoted by 10B.

First entrance restricting portions 30 are arranged in the width direction WD on each of substantially opposite sides of the inner surface of a peripheral wall 12 in the height direction HD as in the first embodiment, and are arranged at substantially constant intervals in the width direction WD. The interval between the respective first entrance restricting portions 30 is larger than in the first embodiment, and the number of the first entrance restricting portions 30 is lower than in the first embodiment.

Further, the first entrance restricting portions 30 are arranged at substantially the same positions as every other pin-like tab 20 in the width direction WD and the first entrance restricting portions 30 on one side in the height direction HD are offset in the width direction WD from those on the other side by half of the interval or pitch.

Also in the case of the third embodiment, when the spherical body 201 is introduced into a drop-in space 3B, the spherical surface thereof is supported on the front ends of the three adjacent first entrance restricting portions 30 and the interference thereof with the respective pin-like tabs 20 is avoided as in the second embodiment.

Figure 15:
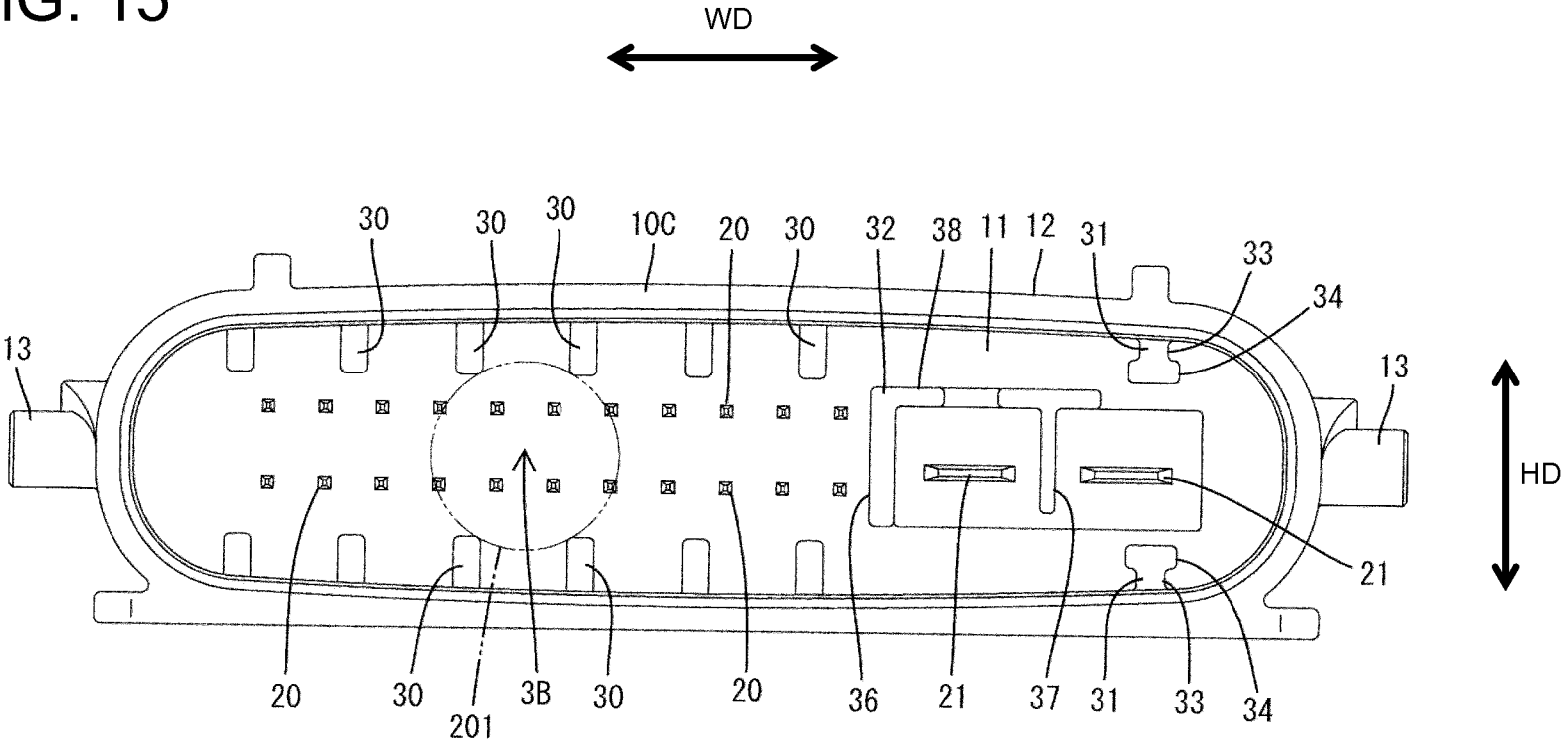
FIG. 15 is a front view of a connector of a fourth embodiment.

FIG. 15 shows a fourth embodiment of the invention. Although the number and array of first entrance restricting portions 30 in the fourth embodiment are different from those of the first embodiment, the other structure is similar or the same as in the first embodiment. Thus, components are denoted by the same reference signs as in the first embodiment in FIG. 15 except a receptacle denoted by 10C.

First entrance restricting portions 30 are arranged in the width direction WD on each of the opposite sides of the inner surface of a peripheral wall 12 in the height direction HD as in the first embodiment, and are arranged at substantially constant intervals in the width direction WD. The interval between the respective first entrance restricting portions 30 is larger than in the first embodiment, and the number of the first entrance restricting portions 30 is lower than in the first embodiment.

Further, the respective first entrance restricting portions 30 are arranged at positions substantially facing middle or intermediate positions between pin-like tabs 20 adjacent in the width direction WD and the first entrance restricting portions 30 on one side in the height direction HD are arranged at the same positions in the width direction WD as those on the other side.

In this case, a drop-in space 3B is formed at an inner side surrounded by four first entrance restricting portions 30 adjacent to each other at the substantially opposite sides of the pin-like tabs 20 in the height direction HD. Thus, the spherical body 201 is dropped or introduced into the drop-in space 3B with the spherical surface thereof supported on the front ends of the respective four adjacent first entrance restricting portions 30. The respective pin-like tabs 20 and the top 202 are arranged at positions different from each other in a planar view when the spherical body 201 is introduced into the drop-in space 3B, and the entire spherical surface including the top 202 does not come contact the respective pin-like tabs 20.

Figure 16:
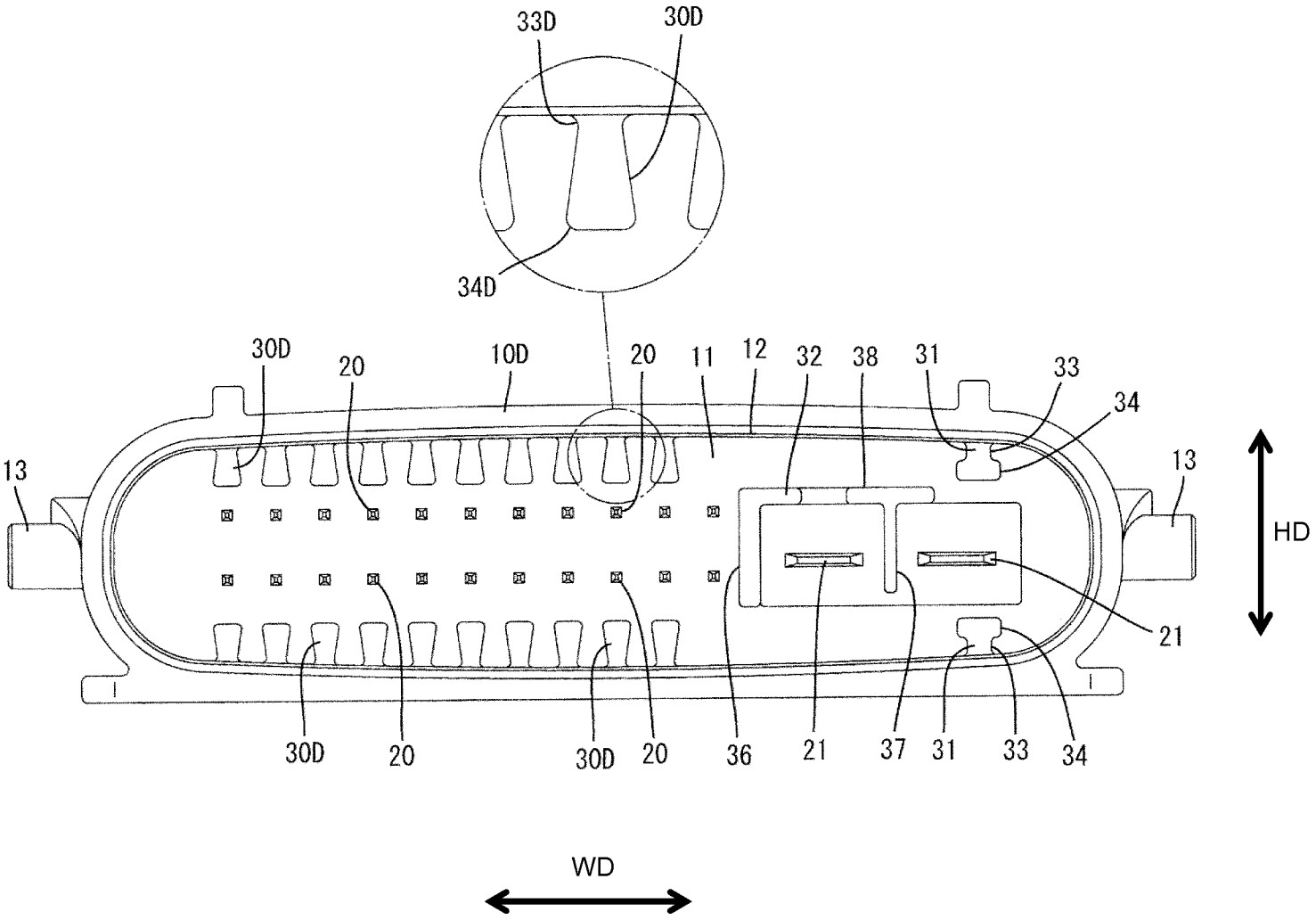
FIG. 16 is a front view of a connector of a fifth embodiment.

FIG. 16 shows a fifth embodiment of the invention. Although the form of first entrance restricting portions 30D in the fifth embodiment is different from that of the first embodiment, the other structure is similar to the first embodiment. Thus, components are denoted by the same reference signs as in the first embodiment in FIG. 16 except the first entrance restricting portions denoted by 30D and a receptacle denoted by 10D.

Similar to second entrance restricting portions 31, each first entrance restricting portion 30D includes a narrow base 33D coupled to the inner surface of a peripheral wall 12 and a wide leading end 34 located in a drop-in space 3B. Unlike second entrance restricting portions 31, the first entrance restricting portions 30D have a dovetailed cross-section whose width is gradually reduced from the leading end 34D to the base 33D. According to the fifth embodiment, sinks are not likely to form on the peripheral wall 12 of the receptacle 10D during molding and external matter will not interfere with the pin-like tabs 20.

Figure 17:
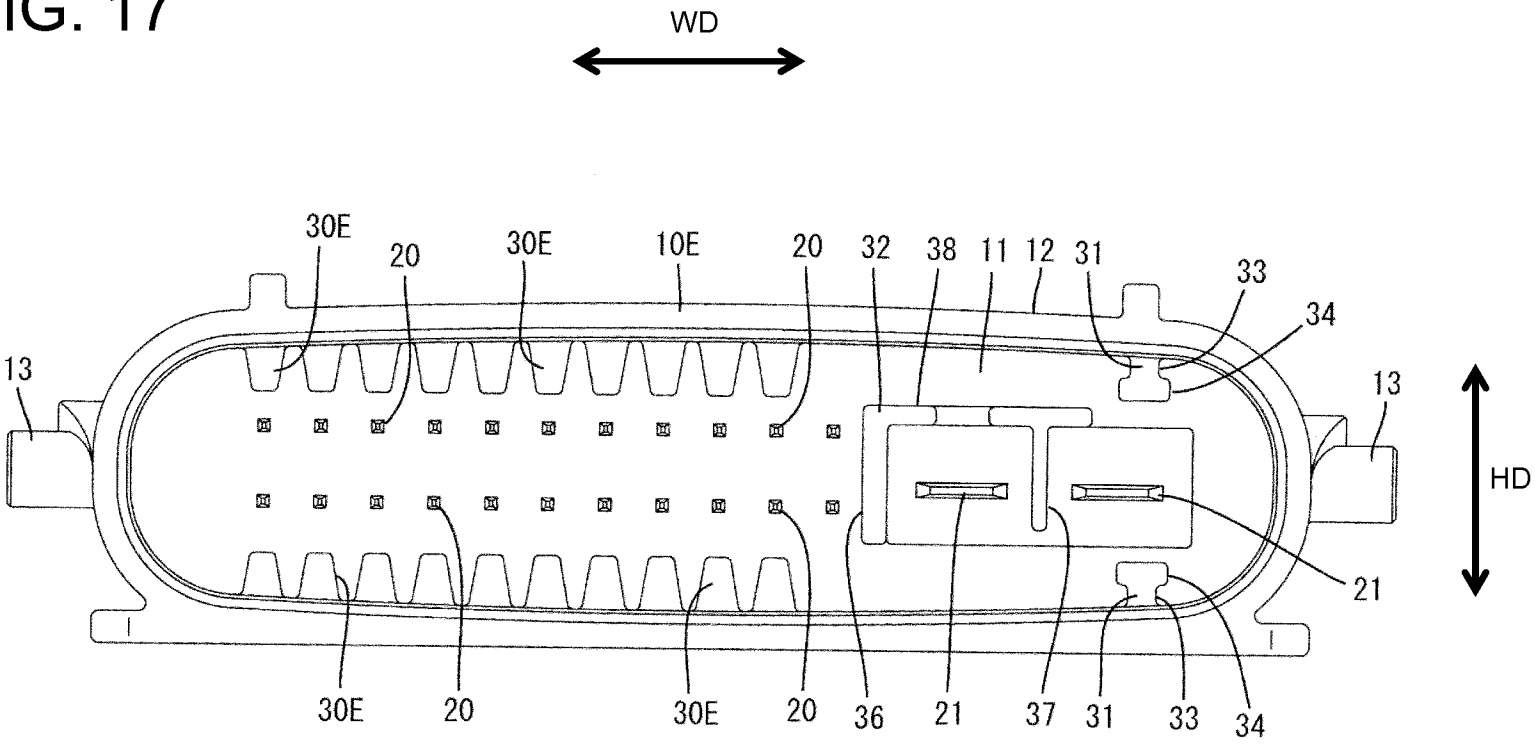
FIG. 17 is a front view of a connector of a sixth embodiment.
Figure 18:
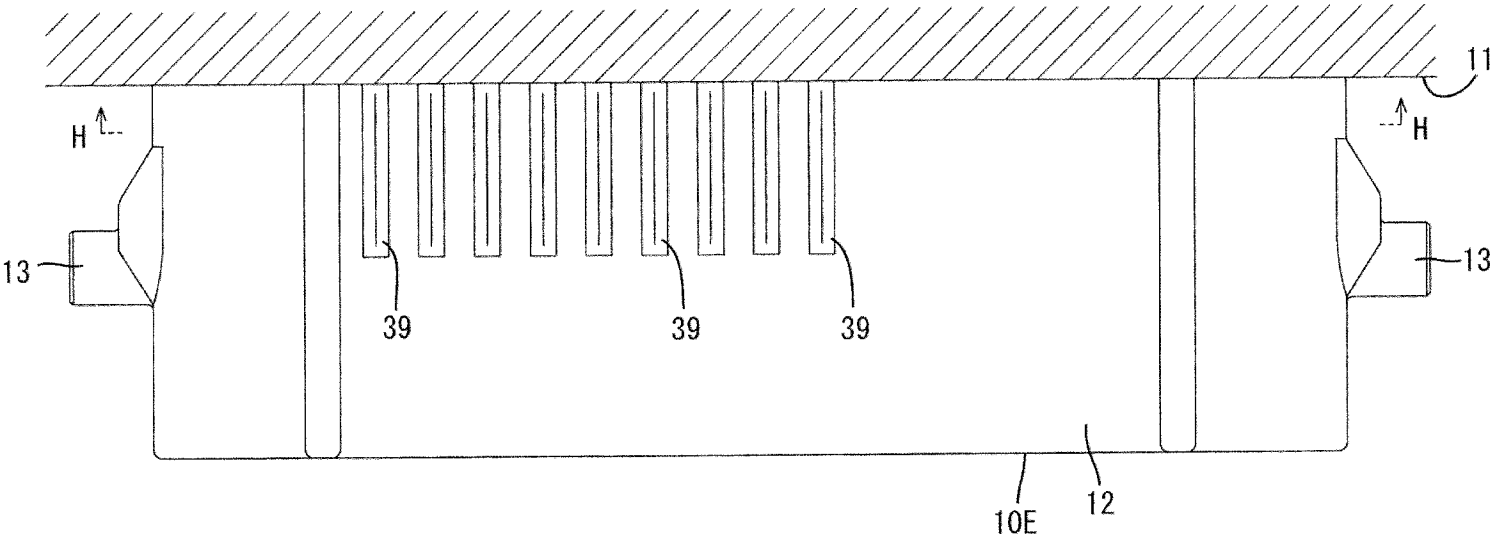
FIG. 18 is a plan view of a connector.
Figure 19:
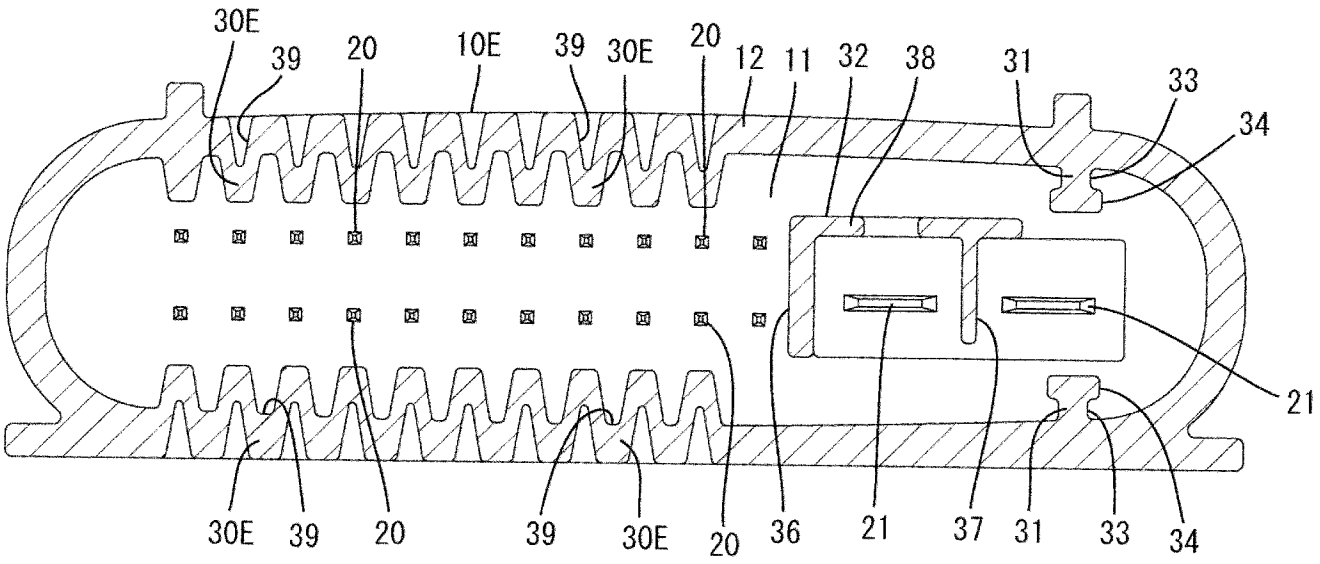
FIG. 19 is a section along H-H of FIG. 18.

FIGS. 17 to 19 show a sixth embodiment of the invention. Although the form of first entrance restricting portions 30E and the form of a peripheral wall 12 in the sixth embodiment are different from those of the first embodiment, the other structure is similar or the same as in the first embodiment. Thus, components other than those different from the first embodiment are denoted by the same reference signs as in the first embodiment in FIGS. 17 to 19 with a receptacle denoted by 10E.

The first entrance restricting portions 30E are formed to have a substantially isosceles trapezoidal front view whose width is reduced gradually from a base end side coupled to the inner surface of the peripheral wall 12 to a leading end side located in the drop-in space 3B as shown in FIG. 17.

Further, a plurality of thinned portions 39 are formed at back-to-back positions facing and substantially opposite to the respective first entrance restricting portions 30E on the outer surface of the peripheral wall 12. As shown in FIG. 18, the respective thinned portions 39 extend in forward and backward directions along the first entrance restricting portions 30E in a rear portion of the peripheral wall 12. Further, as shown in FIG. 19, each thinned portion 39 particularly has a substantially V-shaped cross-section and has a depth as to bite into the corresponding first entrance restricting portion 30E. Thus, in areas where the thinned portions 39 and the first entrance restricting portions 30E are formed, the thinned portions 39 and the first entrance restricting portions 30E are successively arranged without largely changing the thickness of the peripheral wall 12 in the width direction.

According to the sixth embodiment, the respective thinned portions 39 prevent the formation of sinks on the peripheral wall 12 of the receptacle 10E during molding. Further, a large width can be ensured for the base end portions of the first entrance restricting portions 30E.

Figure 20:
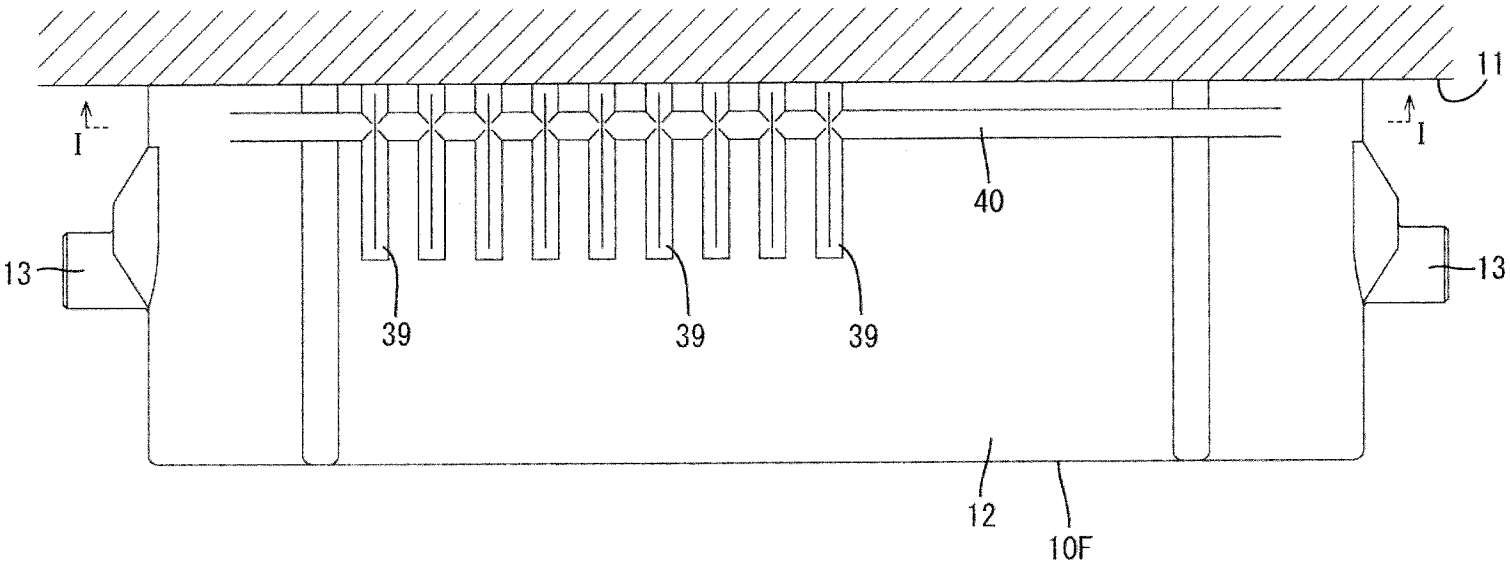
FIG. 20 is a plan view of a connector of a seventh embodiment.
Figure 21:
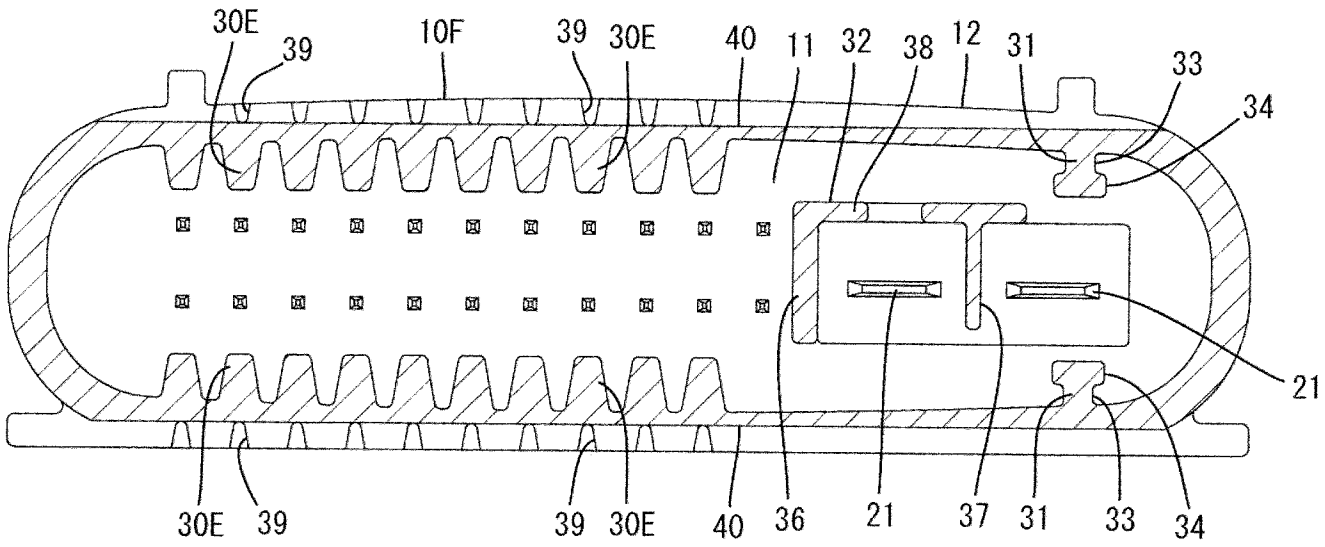
FIG. 21 is a section along I-I of FIG. 20.

FIGS. 20 to 21 show a seventh embodiment of the invention. In the seventh embodiment, a peripheral wall 12 has substantially the same structure as in the sixth embodiment except parts of the outer surface thereof. Thus, components other than those different from the sixth embodiment are denoted by the same reference signs as in the sixth embodiment in FIGS. 20 and 21 with a receptacle denoted by 10F.

As shown in FIG. 20, water drainage portions 40 are formed on the outer surface of a rear end part of the peripheral wall 12. The water drainage portions 40 extend in the width direction WD and open on substantially opposite widthwise ends. Each water drainage portion 40 intersects with rear parts of respective thinned portions 39 and communicates therewith at intermediate positions. As shown in FIG. 21, the water drainage portion 40 has substantially the same depth as the respective thinned portions 39 and/or is arranged substantially along the width direction WD.

In the case of the sixth embodiment, since a plurality of thinned portions 39 are formed on the outer surface of the peripheral wall 12, water may be pooled in the respective thinned portions 39. However, the water drainage portions 40 on the outer surface of the peripheral wall 12 ensure that water that has entered the respective thinned portions 39 can be discharged to outside and does not remain pooled in the thinned portions 39.

Figure 22:
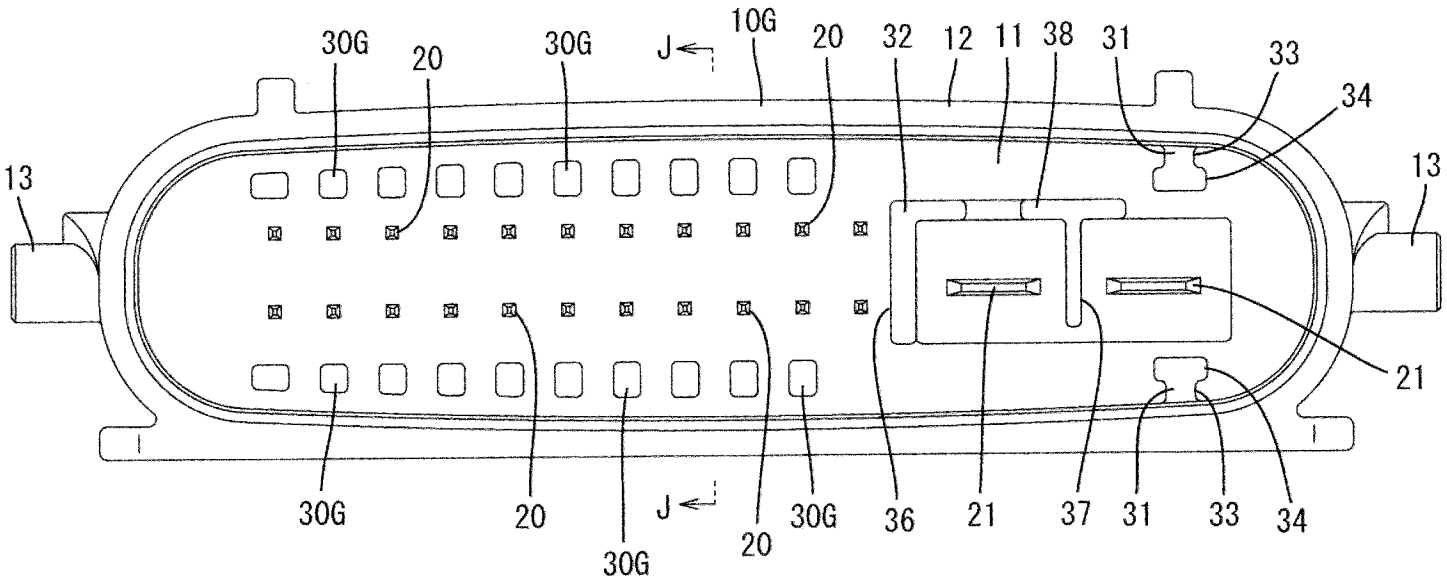
FIG. 22 is a plan view of a connector of an eighth embodiment.
Figure 23:
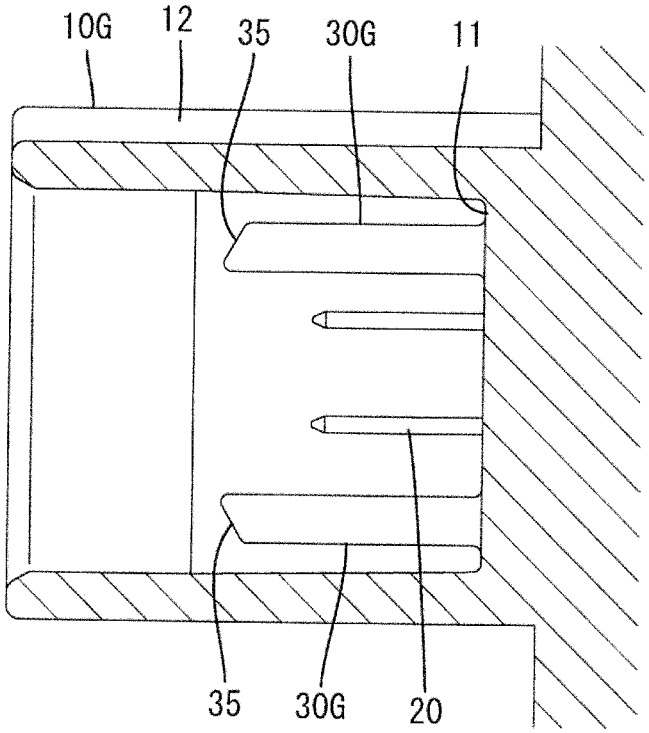
FIG. 23 is a section along J-J of FIG. 22.

FIGS. 22 and 23 show an eighth embodiment of the invention. Although the form of first entrance restricting portions 30G in the eighth embodiment are different from that of the first embodiment, the other structure is similar or the same as in the first embodiment. Thus, components are denoted by the same reference signs as in the first embodiment in FIGS. 22 and 23 except the first entrance restricting portions denoted by 30G and a receptacle denoted by 10G.

The first entrance restricting portions 30G are in the form of substantially rectangular columns projecting forward from the front surface of the back wall 11, and separated from the inner surface of a peripheral wall 12 without being coupled to this inner surface. The array of the first entrance restricting portions 30G is similar or the same as in the first embodiment and the first entrance restricting portions 30G are also similar to the first embodiment in including reverse tapered portions 35.

The first entrance restricting portions 30G of the eighth embodiment are not coupled to the inner surface of the peripheral wall 12. Thus, sinks will not form on the peripheral wall 12 and the deflection of the peripheral wall 12 during molding can be prevented more reliably. A third entrance restricting portion 32 also is not coupled to the inner surface of the peripheral wall 12 and also will not cause the formation of sinks on the peripheral wall 12.

The invention is not limited to the above described and illustrated embodiments. For example, the following embodiments are also included in the technical scope of the present invention.

The intervals between the respective first entrance restricting portions may not be identical.

The intervals between the respective pin-like tabs may not be identical.

The area where the widthwise centers of the respective first entrance restricting portions are the same as those of the respective pin-like tabs may not be included.

The respective first entrance restricting portions may have the same width as the respective pin-like tabs.

The front ends of the first and second entrance restricting portions may be in the form of vertical surfaces extending along the height direction.

Only one entrance restricting portion formed to have a narrow base end portion and a wide leading end portion (first and second entrance restricting portions of the fifth embodiment) may be formed.

What is claimed is:

1. A connector, comprising:

a receptacle with opposite front and rear ends, a back wall and a peripheral wall projecting forward in a rear to front direction from a front surface of the back wall;

tabs mounted through the back wall and projecting forward in the receptacle, the tabs being in at least one row in a width direction that is normal to the rear to front direction; and at least three entrance restricting portions being arranged in the width direction in the receptacle and disposed on each of substantially opposite sides of the plurality of tabs in a height direction that is normal to the rear to front direct and normal to the width direction, a distance from the front end of the receptacle to front ends of the entrance restricting portions being less than a distance from the front end of the receptacle to front ends of the tabs;

wherein:

a plurality of drop-in spaces are arranged successively in the width direction in the receptacle, each drop-in space being formed at an inner side of a plurality of the entrance restricting portions adjacently arranged at substantially opposite sides of the tabs; and when a semi-spherical or spherical body inserted into the receptacle from front and dropped so that a semi-spherical or spherical surface of the body contacts the front ends of the plurality of entrance restricting portions, a top on a central axis of the semi-spherical or spherical body is offset from the tabs in any of the plurality of drop-in spaces.

2. The connector of claim 1, wherein the connector has:

an array area where the plurality of entrance restricting portions arranged on the substantially opposite sides in the height direction are at substantially equal intervals in the width direction; and an array area where the tabs located between the entrance restricting portions in the height direction are arranged substantially at equal intervals in the width direction.

3. The connector of claim 1, wherein there is an overlap area where the plurality of respective entrance restricting portions arranged on the substantially opposite sides in the height direction and the plurality of respective tabs located between the plurality of entrance restricting portions arranged on the substantially opposite sides in the height direction are arranged to overlap with respect to the width direction.

4. The connector of claim 3, wherein the overlap area includes an identical phase area where widthwise center positions of the plurality of respective entrance restricting portions are arranged at the same positions as widthwise center positions of the plurality of tabs in the width direction.

5. The connector of claim 4, wherein the entrance restricting portions have widths equal to or larger than widths of the tabs in the overlap area.

6. The connector of claim 1, wherein the front ends of the entrance restricting portions are in the form of reverse tapers overhanging forward toward the drop-in spaces.

7. The connector of claim 1, wherein the entrance restricting portions arranged on the substantially opposite sides in the height direction are coupled unitarily to an inner surface of the peripheral wall.

8. The connector of claim 7, wherein an outer surface of the peripheral wall is recessed to form a plurality of thinned portions at positions facing and substantially opposite to the respective entrance restricting portions.

9. The connector of claim 8, further comprising at least one water drainage portion formed on the outer surface of the peripheral wall, the water drainage portion extending in a direction intersecting with forward and backward directions, communicating with the plurality of thinned portions and open on both ends.

10. The connector of claim 1, wherein the entrance restricting portions arranged on the substantially opposite sides in the height direction are coupled unitarily to an inner surface of the peripheral wall and at least one of the entrance restricting portions includes a narrow base end portion coupled to the inner surface of the peripheral wall and a leading end portion wider than the base end portion and located in the drop-in space.

11. The connector of claim 1, wherein at least some of the plurality of entrance restricting portions are separated from the peripheral wall.

* * * * *